United States Patent [19]

Wright et al.

[11] 4,434,741

[45] Mar. 6, 1984

[54] ARCTIC BARGE DRILLING UNIT

[75] Inventors: Brian D. Wright; Raymond A. McBeth, both of Calgary, Canada; Egon Wessels, Hamburg, Fed. Rep. of Germany

[73] Assignee: Gulf Canada Limited, Toronto

[21] Appl. No.: 360,252

[22] Filed: Mar. 22, 1982

[51] Int. Cl.[3] ..... B63B 35/08; E02B 15/02

[52] U.S. Cl. ..... 114/264; 114/40; 405/211

[58] Field of Search ..... 405/61, 211; 114/40, 114/264, 230, 257

[56] References Cited

U.S. PATENT DOCUMENTS

| | | | |
|---|---|---|---|
| 4,048,943 | 9/1977 | Gerwick | 114/40 X |
| 4,102,144 | 7/1978 | Anders | 405/211 |
| 4,245,929 | 1/1981 | Pearce et al. | 405/211 |

*Primary Examiner*—David H. Corbin

*Attorney, Agent, or Firm*—R. H. Saunders; D. R. Morrison

[57] ABSTRACT

An improved marine drilling barge for use in ice-covered water is disclosed. The barge has, besides a conventional moon pool through which conventional marine drilling operations can proceed, a roughly circular polygonal hull plan, with an elevation of two truncated pyramid sections joined through their theoretical apices by a vertical walled matching polygonal section. The flat bottom of the hull, to or through which mooring lines are attached to anchor the barge, has an exterior guard member fastened thereto and surrounding the points at which the mooring lines attach or come closest to the hull. The barge is ballasted to achieve downward breaking action by the hull on the ice cover as the latter encroaches on the barge. The proportions of the hull combine with those of the guard member to ensure that the ice broken from the ice cover is deflected to avoid fouling the mooring lines while the maximum draft of the barge is no greater than 20 meters.

4 Claims, 2 Drawing Figures

FIG. 1
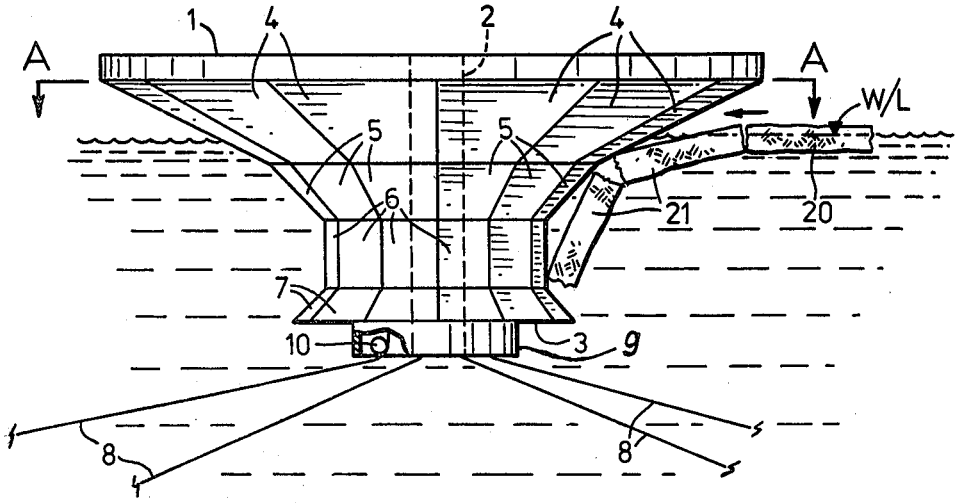
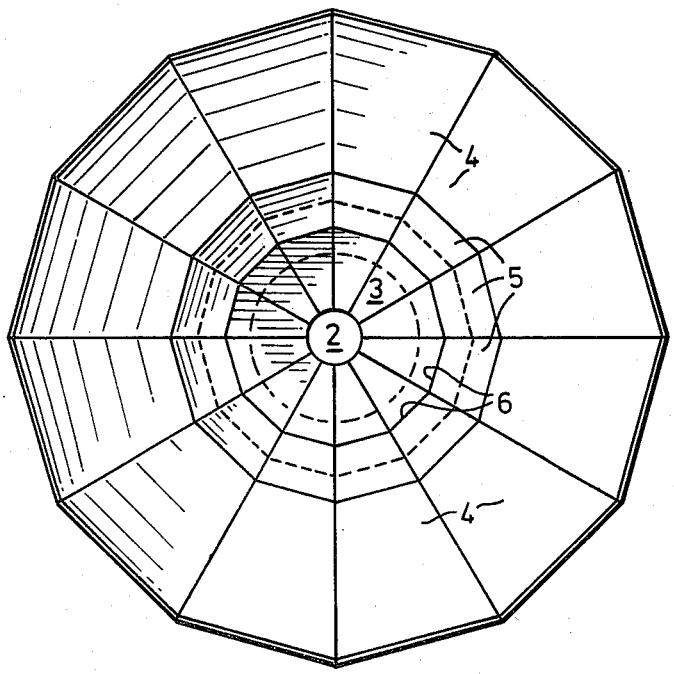
FIG. 2

ARCTIC BARGE DRILLING UNIT

This invention relates to a marine drilling unit of the floating barge type, and more particularly to a unit of said type for use in arctic waters of only moderate depth such as are encountered on a continental shelf, for example in the Beaufort Sea area north of Canada and Alaska.

In shallow arctic waters it has already been found practicable to accommodate drilling rigs by building artificial islands of one type or another on the sea bottom, or on a specially built berm, which resist the forces of moving ice that forms on top of the water; exploratory drilling into the sea bottom can readily be carried out from drilling rigs located on such islands.

In deeper waters where islands cannot be built economically, floating rigs have to be used for drilling, and numerous types of drill ships and drilling barges have been proposed for such work, of which some have been designed to deal with some of the problems created by ice encountered during operation. It is accepted, however, that in water deep enough to be subject to movement of icebergs all drilling vessels, having a displacement of several thousand tonnes at most, must be prepared to move out of the path of approaching icebergs; these frequently have displacements amounting to several million tonnes.

In arctic waters of modest depths, for example in the Beaufort Sea area where the continental shelf underlies the water many kilometers out from the shoreline, creating water depths mostly in the range from 10 to 75 meters, the problem of iceberg or ice island approach occurs infrequently. However, an ice cover extending many kilometers, which forms in this area to thicknesses of one to two meters in autumn and early winter over the waters which open up in the short summer season, creates problems for floating rigs because the ice covering water depths greater than 25 meters is almost constantly moving, under influence of such factors as wind, ocean currents, and the coriolis force. Because a floating drilling rig must remain relatively stationary over its drill hole, to prevent an encroaching ice cover from moving a rig off its location it is necessary to break this ice cover as it approaches a floating drilling rig; the most obvious expedient to achieve this is the use of auxiliary ice-breaking ships, which can break the cover and even large ice ridges therein. This expedient is costly, and more economic expedients are sought.

Attempts have been made to design drilling vessels which themselves can break sheet ice as it encroaches on a vessel. To date, none of these have been found satisfactory for the modest water depths that are encountered over the continental shelf. Thus for example the "Big Buoy" spar buoy designs, having a large diameter submerged caisson to support a working deck on a smaller diameter surface piercing column, are unsuitable because they have too deep a draft to be accommodated in the modest depths over the continental shelf area. It has also been suggested that a conical collar around the surface piercing column at the ice-water line of such designs be used to assist in breaking the ice; such arrangement may be beneficial but in no way does it reduce the draft requirements of the designs, which remain entirely unsuitable for use in water of modest depth. Similarly the structures suggested and disclosed by B. G. Gerwick, in Can. P. 1,074,628 and U.S. Pat. No. 4,048,943, are entirely unsuitable for water of modest depth. These structures utilize a truncated conical or an hour-glass shaped hull at the ice-water line to assist in breaking ice, and enhance the breaking action by active heaving of the structures in the water; means are provided for vertically moving the structures so that the conical wall thereof obliquely contacts surrounding ice with sufficient dynamic force to break the ice. Essential to the vertical heaving action are mooring lines which are substantially vertical in the region close to the hull and are alternately tensioned and relaxed to provide vertical motion (heaving) of the structures. With a minimum draft of about 50 meters and a requirement for vertical mooring lines, it is obvious that these structures are entirely impracticable in waters of modest depth, for example the range from 25 to 75 meters.

It has been determined, by study of relative horizontal movement of models of apex-down truncated cone shape vessels against sheet ice equivalent in thickness to one to two meter thicknesses of ice encroaching on an anchored full scale vessel, that the total load on the mooring system of such vessels is made up of a breaking component (force required to break ice), comprising about 20% to 40% of the total, and a clearing component (force required to resist movement of the vessel by broken ice moving around past the vessel as additional ice encroaches thereagainst) comprising correspondingly about 80% to 60% of the total load. This factor prevails with apex-down conical vessels which exert a downward force on ice to break it and consequently have an upward vertical component of tension placed on the mooring lines as well as a horizontal component of tension caused by the horizontal movement of the ice. It is an unexpected and surprising condition that the clearing component of the mooring line load constitutes such a large proportion of the total load. The factor plays a significant role in the development and construction of the present invention.

It is well recognized in the art that ice encroachment on a moored vessel may come from any direction, and that the most practical shape in plan view for such vessels to counter the encroachment is circular. However an exactly circular plan for the hull of a large vessel is unwarranted because the practical material of construction for marine vessels is straight edge flat steel plates, welded together to provide the closest possible proximity to the desired contour. Consequently the perimeter, in plan view, of the hull of the marine drilling unit to which the present invention applies is a substantially circular polygon, preferably a regular polygon of from 12 to 36 sides, more preferably 20 to 30 sides, and the shape is referred to herein as substantially circular polygonal. The dihedral angle between plates around the perimeter of a regular polygon hull, having 24 sides for example, would be 165 degrees; that for a similar hull with 30 sides would be 168 degrees.

The sum of the horizontal components of the ice breaking and ice clearing forces when transferred to the mooring lines is significantly greater than the sum of the vertical components, as the weight of the vessel assists in reducing the vertical ice breaking and clearing forces. Hence the mooring lines are more effectively employed when they are deployed to anchors which are located at a radius around the centre of the vessel significantly greater than the radius of the perimeter of the vessel. Such deployment is achieved in waters of modest depth without resorting to unduly long mooring lines, but as a result the lines extend for a considerable distance around the vessel at depths not much greater than the points where they are attached to, or achieve their closest proximity to, the underside of the hull. As a consequence, where the attachment points are near the water surface, there can be a severe problem of fouling of the lines by broken ice which must clear past the vessel as ice cover continuously encroaches thereon. The vessel's downward breaking action on the ice forces broken ice below the water surface where, if the ice is to travel past the vessel, it must move under the ice cover adjacent the vessel or around the vessel's submerged hull and into the area beyond the hull in the direction of ice movement or deeper still directly beneath the vessel itself where there is greater likelihood of fouling the mooring lines. The present invention is intended to preclude or substantially eliminate the likelihood of broken ice moving directly beneath a vessel where fouling of, or damage to, its mooring lines by ice is most likely to occur.

The invention is directed to improvements in the ice clearing capability of moored floating barge type vessels which are moored in modest depth water covered by moving ice cover. More particularly, the invention consists, in a marine drilling unit of the floating barge type with draft no greater than 20 meters, for operation in ice-covered water, having a working deck to accommodate drilling equipment, a marine hull to support said deck, a central moonpool penetrating the deck and hull to accommodate a marine drillpipe, and mooring lines attached at their top to said unit via the bottom of said hull and at their bottoms to anchors surrounding said unit at some distance, of the improvements which comprise:

(i) a hull having:

(a) a substantially circular polygonal perimeter in plan view, (b) a matching first polygonal wall substantially in the form of an apex-down truncated cone extending from below the deck, at an angle to the horizontal of from substantially 20 degrees to substantially 55 degrees, preferrably from 30 to 45 degrees, to a level at least below the normal bottom level of ice impinging against the hull, (c) a second matching polygonal wall substantially in the form of an apex-down truncated cone extending from and below said first wall, at an angle to the horizontal from at least as great as the angle of the first polygonal wall to substantially 65 degrees, preferrably substantially 50 degrees, to a level below the bottom of the first wall by a distance at least as great as the normal thickness of ice impinging against the hull, (d) a matching third polygonal wall substantially in the form of a cylinder extending substantially vertically from and below said second wall for a distance at least as great as the normal thickness of ice impinging against the hull, (e) a matching polygonal deflector wall substantially in the form of an apex-up truncated cone extending from and below said third wall, at an angle to the horizontal of from substantially 20 degrees to substantially 65 degrees, preferrably substantially 50 degrees, to a level below the bottom of said third wall by a distance at least as great as the normal thickness of ice impinging against the hull, and (f) a substantially flat annular bottom closing said deflector wall and surrounding said moonpool; and (ii) a substantially circular guard member secured to the flat bottom of said hull, surrounding the points at which the mooring lines achieve their closest proximity to the bottom of the hull, and extending below the flat bottom of the hull for a distance to place the lowest edge of said member at a depth below the water surface at least five times the normal thickness of ice impinging against the hull and not greater than 20 meters.

The present invention may be more readily understood from the following description and reference to the accompanying drawings in which FIG. 1 shows one view, in elevation with a partly cutaway section, of a typical embodiment of the floating barge of the invention and FIG. 2 shows a plan view below the deck level along the line A—A of the barge in FIG. 1.

In FIG. 1, a working deck to accommodate marine drilling equipment is shown as 1, devoid of any such equipment which is conventional. A conventional moonpool, 2, generally circular in cross-section, is shown by dotted lines and penetrates the barge through both the deck and the marine hull bottom, 3. For simplicity of illustration the barge hull is depicted as being a twelve sided regular polygon in plan, as is readily seen in FIG. 2. However in preferred embodiments of the invention a larger number of sides for the regular polygonal shape is preferred, for example 24 to 30, the larger number providing a more nearly circular perimeter. The marine hull of the barge is composed of five main parts, each having a perimeter that approaches a true circular shape as the number of polygonal sides is increased. Furthermore, three of the five main parts approach truncated conical shape as their perimeters approach true circular shape, their shape technically being frusto-pyramidal; for convenience of description herein they are referred to as truncated cone sections. The first of these parts is the apex-down truncated cone section formed by panels 4, on the top of which the deck rests, at least in part. The sloping face of the panels is inclined to the horizontal at an angle of from substantially 20 to substantially 55 degrees, most preferrably substantially 30 degrees. The barge is ballasted so that the lowest water line (W/L) on the hull is at least the normal ice thickness above the bottom edge of these panels; generally it is somewhat higher than this, and generally not above the level of the mid-point of the panels, to maintain appropriate freeboard. The second main part of the hull is another apex-down truncated cone section, formed by panels 5, depending below panels 4 with their sloping face inclined to the horizontal at an angle of from substantially 20 to substantially 65 degrees and in any case an angle equal to or greater than that of the first truncated cone section. The third main part of the hull is a vertical polygonal, substantially cylindrical, section formed by panels, 6, depending below panels 5. The fourth main part of the hull is an apex-up truncated cone section formed by panels, 7, depending below panels 6 with their sloping face inclined to the horizontal at an angle to the horizontal of from substantially 40 to substantially 60 degrees. The fifth main part of the hull is the bottom, 3, which is substantially flat below the bottom of the panels 7 and completes the hull surrounding the moonpool 2, which opens through it. A number of mooring lines, 8, are attached to the floating barge, to maintain it in position for drilling, and are attached directly to the bottom of the hull or, more generally, via fairleads on the bottom of the hull to winches inside the hull or on the working deck, with the lines being led inside through the hull bottom to winches in a conventional manner. Because the depth of the water, for use in which the drilling unit of the present invention is intended, is generally only a modest depth, the mooring lines usually must run out from the barge to their respective anchor points on the marine floor at very shallow angles. In any event, the manner of attachment of the mooring lines to the barge can be conventional, but the critical consideration is that, regarding the points at which the lines achieve their closest proximity to the hull, either by attachment directly thereto or by passing therethrough via fairleads, 10, said points must be within the perimeter of the flat bottom of the hull and preferrably surrounded by a substantially circular guard member, 9, which extends, conveniently simply as substantially cylindrical wall, below the flat bottom of the hull for a distance that precludes moving ice from being trapped by the mooring lines or between any mooring line and the flat bottom of the hull; to achieve this desideratum the lowest edge of the guard member must be at a depth below the water surface at least five times the normal thickness of ice impinging against the hull, but not greater than substantially 20 meters.

When a continuous ice cover, which may extend for many kilometers in all directions around a floating barge of the present invention, begins to move and to encroach on the barge, the ice cover, illustrated as 20 in FIG. 1, is bent and forced beneath the water surface, at W/L, until fracture of the ice occurs and pieces, such as 21, break from the cover and are forced, by their inertia and the moving, encroaching ice, to submerge under the adjacent hull, the adjoining cover, or completely under the bottom of the barge. The contour of the hull, formed by the wall section panels 4,5,6, and 7, forces encroaching ice to bend, submerge, and break off, and compels broken pieces such as 21, pushed forward by additional encroaching ice, either to turn downwards and backwards, thence to float up and accumulate to some extent under the encroaching ice cover, or to turn downwards and thence aside to move around the hull or to float up and accumulate under the ice cover beside the barge, where they move past the barge under unbroken ice moving as part of the encroaching ice cover. The panels 7 adjacent the bottom of the hull 3 form a deflector wall or skirt which ensures that loose floating ice pieces such as 21, which are being pushed downwards and generally towards the center line of the barge by encroaching ice, are turned away from the hull and generally do not submerge further. The depth to which loose ice is likely to travel depends on several factors, including the thickness of the impinging ice cover, the speed with which it is pushed by encroaching ice behind it, the depth to which loose ice has already accumulated on the barge hull and under the ice cover adjacent the barge, and the buoyancy of the ice tending to return it to the surface, among others. In accordance with the present invention the flat bottom of a barge hull is at a depth below the water line of at least four times the normal thickness of ice impinging against the hull. To provide protection against fouling of the mooring lines by loose ice, the present invention provides a guard member that surrounds the points at which the mooring lines attach or come closest to the hull and extends a distance below the hull bottom to place the lowest edge of the member at a depth below the water surface at least five times the normal thickness of ice impinging against the hull without extending to a depth over substantially 20 meters. This guard member surrounds the area in which the mooring lines approach closest to one another; most conveniently it is in the form of a steel ring fastened to the hull bottom, for example by welding, to divert loose ice moving towards the moonpool and mooring line convergence at depths below the water surface substantially at least five times the normal thickness of the ice. With, for example, Beaufort Sea ice thickness of two meters, the bottom of the guard member would be at a depth of at least 10 meters below the water line, a depth adequate to provide the desired protection of the mooring lines against fouling by loose ice from ice cover substantially two meters thick.

It is appreciated that, as a winter season progresses in arctic areas, the normal thickness of ice impinging against any vessel moored therein tends to increase significantly with the advent of pressure ridges in the moving ice cover; the pressure ridges can increase dramatically in both thickness and frequency as winter progresses, and make movement of the ice cover as threatening as an iceberg with respect to a moored vessel. However, for a considerable time after initial freeze-up and the formation of continuous ice cover, for example for the time until the ice cover has developed to a thickness of up to one meter or even two meters with ridge formation manageable by auxiliary ice breakers, in water depths, for example, of 20 to 70 meters, the floating barge drilling units of the present invention can easily remain in use and accommodate the random movement of the ice cover. Within the ranges of hull angle sizes and wall dimensions disclosed herein, stable drilling barges having a draft less than 20 meters can readily be built. Such barges can safely and readily be towed from one location to another in open water and broken-ice covered water for drilling operations or for winter harboring. By virtue of their ice-breaking and clearing ability, they are able to remain on location for drilling for a much longer season than barges that must be moved when freeze-up starts; in particular, the normal Beaufort Sea drilling season from mid-August to mid-October may be extended into January before ice cover thickness and ridging make it necessary to suspend drilling and move to harbor until the next summer season.

It will be obvious to those skilled in the art that numerous variations may be made in the specific embodiment described without departing from the scope of the invention claimed herein. Thus the polygonal hull plan may be covered by a deck that is simply round or rectangular in plan, with portions of such deck cantilevered over the top of the polygonal hull. The hull may be braced and/or compartmentalized in its interior in any appropriate manner desired, for example for ballasting, its essential features for the present invention being merely as set forth herein with respect to its exterior configuration. The moonpool size and configuration can be conventional, for example a round moonpool of diameter one-sixth to one-twelfth of the deck diameter is appropriate. The number of mooring lines used to hold the barge in place can vary, depending on the ice load it is intended to resist. They are, of course, most advantageously evenly distributed around the perimeter of the hull, with generally between eight and sixteen in number being adequate. The number selected is minimized to reduce risk of fouling by the ice sheet but at the same time provide adequate holding power with available mooring line size.

Numerous modifications can be made in the various expedients described without departing from the scope of the invention which is defined in the following claims.

What is claimed is:

1. In a marine drilling unit of the floating barge type, with draft no greater than 20 meters for operation in ice-covered water, having a working deck to accommodate drilling equipment, a marine hull to support said deck, a central moonpool penetrating the deck and hull to accommodate a marine drillpipe, and mooring lines attached at their top to said unit via the bottom of said hull and at their bottoms to anchors surrounding said unit at some distance, the improvements which comprise:

(i) a hull having (a) a substantially circular polygonal perimeter in plan view, (b) a matching first polygonal wall substantially in the form of an apexdown truncated cone extending from below the deck, at an angle to the horizontal of from substantially 20 degrees to substantially 55 degrees, to a level at least below the normal bottom level of ice impinging against the hull, (c) a second matching polygonal wall substantially in the form of an apexdown truncated cone extending from and below said first wall, at an angle to the horizontal from at least as great as the angle of the first polygonal wall to substantially 65 degrees, to a level below the bottom of the first by a distance at least as great as the thickness of ice impinging against the hull, (d) a matching third polygonal wall substantially in the form of a cylinder extending substantially vertically from and below said second wall for a distance at least as great as the normal thickness of ice impinging against the hull, (e) a matching polygonal deflector wall substantially in the form of an apex-up truncated cone extending from and below said third wall, at an angle to the horizontal of from substantially 20 degrees to substantially 65 degrees, to a level below the bottom of said third wall by a distance at least as great as the normal thickness of ice impinging against the hull, and (f) a substantially flat annular bottom closing said deflector wall surrounding said moonpool; and (ii) a substantially circular guard member secured to the flat bottom of said hull, surrounding the points at which the mooring lines achieve their closest proximity to the bottom of the hull, and extending below the flat bottom of the hull for a distance to place the lowest edge of said member at a depth below the water surface at least five times the normal thickness of ice impinging against the hull and not greater than 20 meters.

2. In a marine drilling unit, the improvements as claimed in claim 1 in which the polygonal hull perimeter is a regular polygon having 24 sides.

3. In a marine drilling unit, the improvements as claimed in claim 2 in which the first polygonal wall is at an angle to the horizontal of substantially 30 degrees and the second polygonal wall and the deflector wall each are at an angle to the horizontal of substantially 50 degrees.

4. In a marine drilling unit, the improvements as claimed in claim 3 for operation in water covered by a moving ice cover from one to two meters in thickness, wherein the first polygonal wall extends to level at least two meters below the water line, the second polygonal wall extends to a level at least two meters below the bottom of the first polygonal wall extends to a level at least two meters below the bottom of the second polygonal wall, the deflector wall extends to a level at least two meters below the bottom of the third polygonal wall, and the bottom of the circular guard member extends to a depth at least ten meters below the water line on the hull.

* * * * *